US008141180B2

(12) United States Patent
Hof

(10) Patent No.: US 8,141,180 B2
(45) Date of Patent: Mar. 27, 2012

(54) INSERT FOR A COUNTER-CURRENT SWIMMING POOL

(76) Inventor: Georg Hof, Purkersdorf (AT)

( * ) Notice: Subject to any disclaimer, the term of this patent is extended or adjusted under 35 U.S.C. 154(b) by 1286 days.

(21) Appl. No.: 11/814,144

(22) PCT Filed: Jan. 17, 2006

(86) PCT No.: PCT/AT2006/000020

§ 371 (c)(1),
(2), (4) Date: Jul. 17, 2007

(87) PCT Pub. No.: WO2006/076755

PCT Pub. Date: Jul. 27, 2006

(65) Prior Publication Data

US 2008/0127405 A1 Jun. 5, 2008

(30) Foreign Application Priority Data

Jan. 18, 2005 (AT) ..... A 76/2005

(51) Int. Cl.
*E04H 4/00* (2006.01)

(52) U.S. Cl. ..... 4/488

(58) Field of Classification Search ..... 4/509, 488–489, 4/491, 904; 472/82; 482/55; 280/15, DIG. 2, 280/47.131
See application file for complete search history.

(56) References Cited

U.S. PATENT DOCUMENTS 1,731,554 A * 10/1929 Wheeler ..... 472/82
2,035,835 A * 3/1936 Raber ..... 4/488
2,822,183 A * 2/1958 Montgomery ..... 280/47.131
4,170,799 A * 10/1979 Ratelband ..... 4/488
4,197,815 A * 4/1980 Brazelton ..... 4/492
4,429,867 A * 2/1984 Barber ..... 472/13
4,845,787 A * 7/1989 Lior ..... 4/488
4,903,352 A * 2/1990 Murakami ..... 4/541.3
4,907,304 A * 3/1990 Davidson et al. ..... 4/488
5,005,228 A * 4/1991 Mermelstein ..... 4/488
5,044,021 A * 9/1991 Murdock ..... 4/488
5,207,729 A * 5/1993 Hatanaka ..... 4/492
5,246,345 A * 9/1993 Adams, Jr. ..... 416/247 A
5,271,106 A * 12/1993 McClish et al. ..... 4/494
(Continued)

FOREIGN PATENT DOCUMENTS

AT 311618 B 11/1973
(Continued)

*Primary Examiner* — Lori Baker
(74) *Attorney, Agent, or Firm* — Henry M. Feiereisen

(57) ABSTRACT

The invention relates to a kit for a counter-current swimming pool, wherein water is pumped inwards on a defining wall of a swimming pool (1) along the entire horizontal extension thereof and is discharged on the opposite boundary wall along the entire horizontal extension thereof. In order to enable retrofitting of the kit into existing swimming pools, an insert (2, 3) is formed or incorporated into the swimming pool (1), comprising a cover plate (4, 5) which defines the swimming area below and from which boundary walls (6, 8) emanate. The boundary walls extend in a parallel or substantially parallel manner as far as the bottom of the swimming pool, wherein, in the region between the boundary walls (6, 8), axial propelling means, i.e. propellers (10) are provided together with a drive device and wherein the cover plates (4, 5), when seen in the direction of flow, terminate both on the front end (14) and rear end (15) with the formation of a gap (16, 17), which is used to pump in or to discharge water, at a distance from the adjacent wall of the swimming pool.

10 Claims, 1 Drawing Sheet

U.S. PATENT DOCUMENTS

| | | | | |
|---|---|---|---|---|
| 5,273,399 | A * | 12/1993 | Ojeda | 416/146 R |
| 5,315,720 | A * | 5/1994 | Lior | 4/488 |
| 5,367,719 | A * | 11/1994 | Mermelstein | 4/488 |
| 5,494,465 | A * | 2/1996 | Jenkins | 440/71 |
| 5,758,369 | A * | 6/1998 | Takahashi et al. | 4/488 |
| 5,791,955 | A * | 8/1998 | Rinck | 440/113 |
| 6,154,140 | A * | 11/2000 | Thorpe et al. | 340/573.6 |
| 6,190,220 | B1 * | 2/2001 | Borrelli | 440/78 |
| 6,315,911 | B1 * | 11/2001 | Radsky | 210/776 |
| 6,860,057 | B1 * | 3/2005 | Petaja-Suvanto | 43/4 |
| 7,086,994 | B2 * | 8/2006 | Turak et al. | 482/54 |
| 7,330,123 | B1 * | 2/2008 | Grahn et al. | 340/573.6 |
| 7,403,135 | B1 * | 7/2008 | Kaski et al. | 341/33 |
| 7,526,820 | B2 * | 5/2009 | Murdock et al. | 4/492 |
| 7,614,094 | B2 * | 11/2009 | Wolfe | 4/504 |
| 7,846,072 | B1 * | 12/2010 | Bellerive | 482/55 |
| 2002/0046817 | A1 * | 4/2002 | Last | 160/133 |
| 2002/0191815 | A1 * | 12/2002 | Meniere et al. | 382/103 |
| 2003/0077389 | A1 * | 4/2003 | Jones | 427/355 |
| 2005/0170936 | A1 * | 8/2005 | Quinn | 482/55 |
| 2008/0127405 | A1 * | 6/2008 | Hof | 4/496 |
| 2008/0148470 | A1 * | 6/2008 | Ferriss et al. | 4/541.1 |

FOREIGN PATENT DOCUMENTS

| | | | |
|---|---|---|---|
| DE | 2237800 | A1 | 2/1974 |
| DE | 8311105 | U1 | 11/1990 |
| DE | 20005487 | U1 | 8/2000 |
| FR | 2822183 | A | 9/2002 |
| GB | 935054 | A | 8/1963 |

* cited by examiner

INSERT FOR A COUNTER-CURRENT SWIMMING POOL

BACKGROUND OF THE INVENTION

The invention relates to a kit for a counter-current swimming pool for swimming pools, wherein water is pumped in across the entire horizontal extent of a boundary wall of a swimming pool and discharged across the entire horizontal extent of the opposite boundary wall, wherein the counter-current swimming pool has a cover plate which bounds the swim space of the swimming pool downwards, with boundary walls extending from the cover plate to the swimming pool floor and defining flow channels, wherein axial feed units, e.g., propellers, are provided in the region between the boundary walls, and wherein the cover plate, when viewed in the flow direction, terminates both at the front end and at the rear end with a spacing to the adjacent swimming pool wall by forming a gap for pumping water in and discharging water.

A number of swimming pools employing counter-current swimming pools are known in the art.

U.S. Pat. No. 1,731,554 A discloses a swimming pool which includes a counterflow system, wherein an intermediate bottom or a collection tube is provided which is spaced from the front wall and rear wall, and wherein one or more propellers or the like producing a water current are arranged between the bottom and the floor. These propellers are driven by a motor which is arranged outside the intermediate bottom and which drives the propellers via a shaft.

In another conventional embodiment, one boundary wall has openings for inflow of water into the swimming pool. The openings are arranged next to one another horizontally and are connected at the backside of the swimming pool wall by a distribution channel, with a pump forcing water into the distribution channel, with the water being suctioned off at the opposite side of the swimming pool via a collection system. Disadvantageously, such arrangement requires considerable space to be set aside for both the distribution channel and the collection channel at opposite ends of the swimming pool as well as for the pump, which makes it very difficult to install a counter-current swimming pool, in particular in small swimming pools.

Moreover, the counter-current system must already be taken into consideration during the planning stage, because the walls of the swimming pool must be configured accordingly and the aforementioned additional space must be provided.

SUMMARY OF THE INVENTION

It is an object of the invention to provide a system of the afore-described type, which can be effectively deployed in small swimming pools and which can later be installed in existing pools.

The object is solved by the invention in that the kit is designed as a self-contained separate unit, wherein the drive systems for the axial feed unit are also arranged in the region between the pool floor and the cover plate.

With this approach, the outside dimensions of the swimming pool need not be enlarged and substantially laminar flow is attained inside the swimming space in the pool, i.e., substantially the same flow conditions exist across the entire width of the swimming pool.

Advantageously, all axial feed units may be separated from one another with respect to the flow characteristics by parallel or substantially parallel separation walls. With this approach, a defined flow is also obtained below the cover plate, so that the individual axial feed units do not interfere with one another. In addition, by forming separate flow channels, the feed units may be controlled separately for obtaining a laminar flow. To obtain a substantially uniform flow in the swimming region, deflection units may be provided at least in the region of the gap where water is pumped in, for deflecting the water flow without creating turbulence. In addition, the gaps between the end faces of the cover plate and the interior wall surface of the swimming pool may be covered with grates having a low flow resistance, which may affect the flow not at all or only slightly and may also prevent a swimmer from slipping off the cover plate. For a particularly simple adaptation to existing swimming pools, the kit may be made from several modules. In addition, sensors may be provided for controlling the power of the axial feed units, so that the flow velocity is automatically adjusted to match the swimming ability of the swimmer. In particular for athletes and the like and for rehabilitation exercises, the sensors may be provided for monitoring the position of a swimmer. A safety switch or touch strap can be implemented as a disconnect at the "foot end."

BRIEF DESCRIPTION OF THE DRAWING

The drawings show an exemplary embodiment of the system of the invention.

DETAILED DESCRIPTION OF PREFERRED EMBODIMENTS

Figure 3:
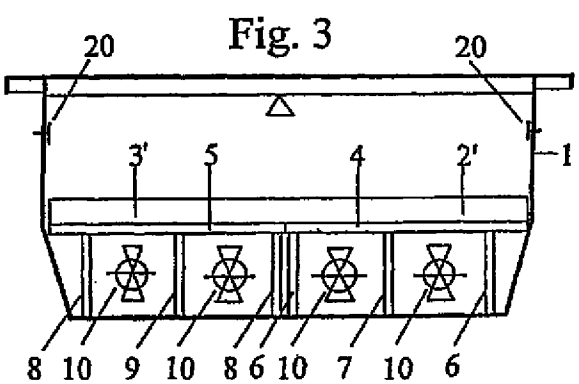
FIG. 3 shows a vertical cross-section taken along the line III-III of FIG. 2.
Figure 2:
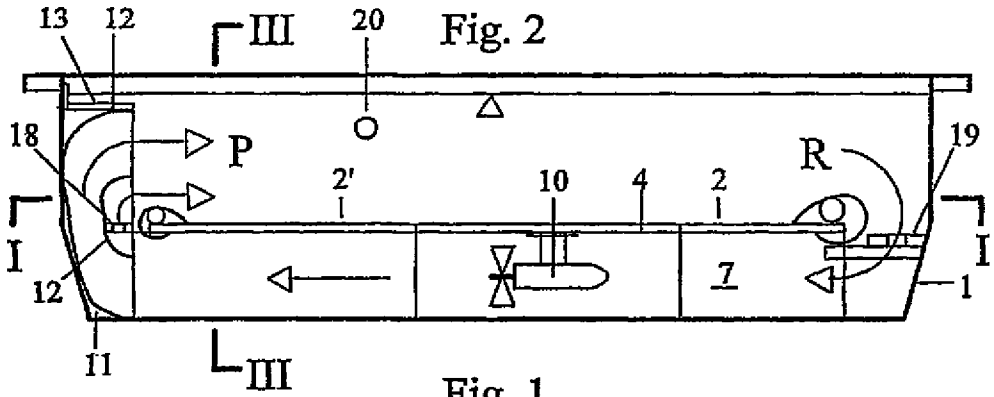
FIG. 2 shows a vertical cross-section taken along the line II-II of FIG. 1.

The swimming pool is designated in general with the reference symbol 1, with inserts 2 and 3 arranged in the swimming pool 1. In this exemplary embodiment, two modular inserts are arranged side by side; however, a one-piece insert covering the entire width of the swimming pool could also be selected. In addition, in the present example, each insert is divided into two sections in the flow direction of the water, consisting of a part 2 and another part 2', and 3 and 3', respectively, wherein both parts of each insert 2, 3 each have their own cover plate 4 and 5, from which mutually parallel or essentially parallel boundary walls 6 and 8, which extend to the pool bottom, are provided, as well as separation walls 7 and 9, which are likewise provided in the sections 2 and 2', and 3 and 3', respectively. The channels defined by the boundary walls 6 and 8 and the separation walls 7 and 9, respectively, below the cover plates 4, 5 include axial feed units 10, which propel the water in the direction indicated by arrows P and R. As indicated in the present example, the axial feed units 10 can be implemented as conventional ship propulsion systems driven by electric motors, i.e., the axial feed units are equipped with a watertight electric motor operating at 12 or 24 V and connected to a conventional ship propeller.

In the illustrated exemplary embodiment, the boundary and separation walls are disposed along the entire length of the respective inserts 2, 2' and 3, 3'. However, particularly the separation walls 7 and 9 are important in the region of the axial feed units 10, so that a particular propeller does not adversely affect the flow of the other propellers. Advantageously, the separation walls 7 and 9 also support the cover plates 4, 5 and thereby enhance the rigidity of the bottom.

Deflection units 11, 12 are provided at the end 14 of the cover plates 4, 5 downstream of the axial feed units 10 for an essentially vortex-free deflection of the water flow. Alternatively, only the indicated deflection angle 13 could be provided (not shown), which may be adequate for smaller systems with reduced water flow. The incoming and outgoing water flow can also be guided across split deflection units for improving the laminar flow.

Gaps 16 and 17, through which the water circulates, are arranged between a corresponding wall of the swimming pool and, on one hand, the end 14 of the cover plates 4, 5 located downstream of the axial feed units 10 in the flow direction and, on the other hand, the end edge 15 provided for suction. For safety reasons, each of these gaps is covered by a respective grate 18 and 19, which is designed to have a low flow resistance so as not to impede the flow and to also ensure an essentially laminar flow across the entire width in the region of the swimmer.

Figure 1:
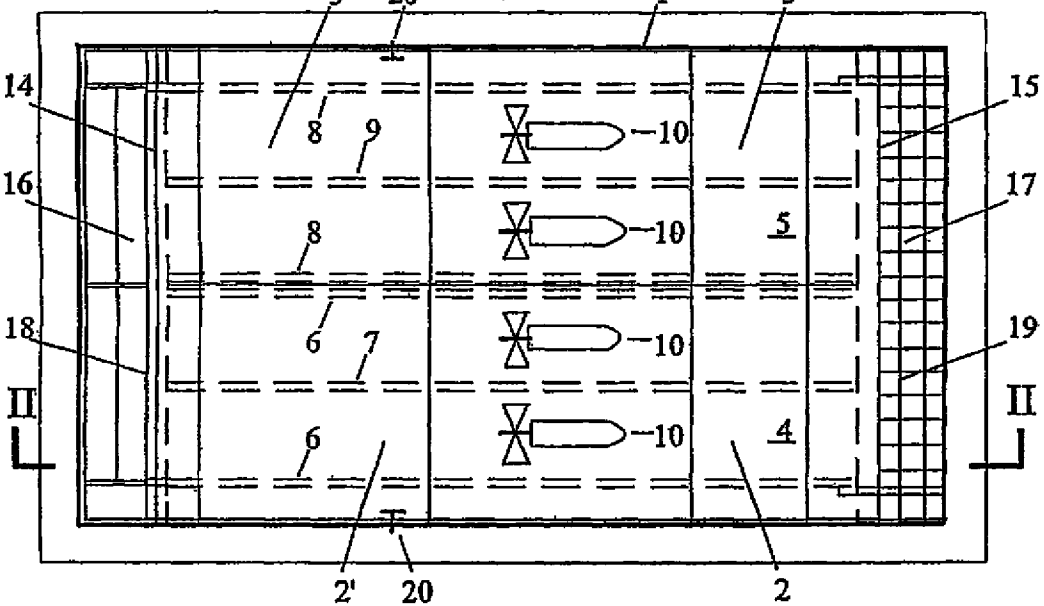
FIG. 1 shows a top cross-sectional view of the system of the invention taken along the line I-I of FIG. 2.

As indicated in FIG. 1, sensors 20 for monitoring the position of the swimmer may also be provided. These sensors can be used to automatically adjust the power level of the axial feed units 10; for example, if the swimmer drops back relative to the current, the power of the axial feed unit 10 can be reduced; conversely, if the current is too slow, the swimmer advances in relation to the current, in which case the drive power of the axial feed units 10 should be increased. In this way, it can be monitored if the swimmer is tiring or is still strong enough, which is important not only for therapeutic purposes so as not to overexert or endanger the swimmer, but also for swimmer athletes who must maintain a corresponding training pace.

What is claimed is:

1. An insert for converting an existing swimming pool to a counter-current swimming pool, said existing swimming pool having a length defined by first and second opposing end walls, a width defined by first and second opposing side walls, and a floor, the insert comprising:

a cover plate having a front end and a rear end, said front end and rear end spaced apart from a corresponding adjacent first and second end wall by a respective gap, with water being pumped in and discharged through the respective gap;

one or more boundary walls extending from the cover plate to a floor of the existing swimming pool in a lengthwise direction of the existing swimming pool and defining flow channels therebetween, and a plurality of axial feed units disposed inside the flow channels between the front end and the rear end of the cover plate, with each axial feed unit comprising a water propulsion system formed as a single unit with a dedicated drive system, wherein the water propulsion system pumps pool water through the flow channels by taking in the pool water across the entire width of the existing pool near the first end of the existing pool and discharging the pool water into the existing pool across the entire width of the opposing second end of the existing pool in a flow direction.

2. The insert of claim 1, wherein the water propulsion systems each comprise a propeller.

3. The insert of claim 1, further comprising parallel or substantially parallel separation walls separating the water propulsion systems from one another.

4. The insert of claim 1, further comprising deflection units disposed at least in a region of the respective gap where water discharged into the existing pool, for deflecting water flow without creating turbulence.

5. The insert of claim 1, further comprising grates having a low flow resistance which cover the respective gaps formed between the front end and the rear end of the cover plate and a corresponding adjacent end wall.

6. The insert of claim 1, wherein the insert comprises at least two modules arranged side-by-side in the lengthwise direction of the existing swimming pool, each module comprising a cover plate, at least one boundary wall, and at least one axial feed unit.

7. The insert of claim 1, further comprising at least one sensor for controlling power to the axial feed units.

8. The insert of claim 7, wherein the at least one sensor monitors a position of a swimmer.

9. The insert of claim 1, wherein the drive system comprises a watertight electric motor.

10. The insert of claim 9, wherein watertight electric motor operates at 12 V or 24 V.

* * * * *